United States Patent [19]

Gitchel

[11] 4,022,144

[45] May 10, 1977

[54] SAILING CRAFT

[76] Inventor: James Wallace Gitchel, 11050 Fancher Road, No. 138, Westerville, Ohio 43081

[22] Filed: Apr. 15, 1976

[21] Appl. No.: 677,362

[52] U.S. Cl. ..... 114/104

[51] Int. Cl.[2] ..... B63H 9/10

[58] Field of Search ..... 114/102, 104–107, 114/39

[56] References Cited

UNITED STATES PATENTS

| | | | |
|---|---|---|---|
| 3,251,329 | 5/1966 | Smith | 114/102 |
| 3,260,230 | 7/1966 | Kauert | 114/106 |
| 3,310,018 | 3/1967 | Roberts, Jr. et al. | 114/104 |
| 3,851,609 | 12/1974 | Stearn | 114/105 |

FOREIGN PATENTS OR APPLICATIONS

| | | | |
|---|---|---|---|
| 2,157,240 | 5/1973 | Germany | 114/104 |

*Primary Examiner*—Trygve M. Blix
*Assistant Examiner*—Stuart M. Goldstein
*Attorney, Agent, or Firm*—Richard P. Matthews

[57] ABSTRACT

An apparatus for launching and retracting one or more sails of a sailing craft includes a reversible drive for rotating a drum. A rope or other elongated flexible element connects with movable parts of the one or more retractable sails and extends in a substantially continuous loop with a reach of the loop drivingly engaging the peripheral surface of the drum. Guides tension the loop and support the sail connection portions of the flexible element for movement between locations where the movable sail parts are launched and retracted. In preferred practice, the drive includes a radio signal responsive remote control system, and the apparatus operates to selectively launch and retract spinnaker and jib sails.

25 Claims, 6 Drawing Figures

SAILING CRAFT

REFERENCE TO RELATED PATENT

*Dynamic Balance Sail Control*, U.S. Pat. No. 3,765,362 issued Oct. 16, 1973 to James Wallace Gitchel, here the "Remote Control Boat Patent", the disclosure of which is incorporated by reference.

BACKGROUND OF THE INVENTION

1. Field of the Invention

The present invention relates generally to sailing craft, and more particularly to a remote-control system for launching and retracting one or more sails of a sailing craft.

2. Prior Art

Remote control systems for turning the rudder and trimming the sails of sailing craft are known and have drawn great interest to the hobby of building and operating scale model sailing craft. One such system is described in the referenced Remote Control Boat Patent, and includes a reversible electric motor drive operated by a radio signal responsive servo switch.

Prior to the availability of remote control systems, the rudder and sails of a model craft were set in substantially fixed positions before the craft was launched. Once the craft was in the water, the direction it sailed was the result of combined effects of wind and seas. Sailing the craft from a point on shore out into a body of water and back to the same point on shore was virtually impossible unless, by some chance, variations of wind and seas combined to so direct the craft.

A problem with previously proposed model sailing craft is that, while the trim of one or more sails can be remotely controlled from shore, it has not been possible to launch and retract selected sails and to thereby more accurately test the skills of a sailor.

A further problem is that, inasmuch as a jib sail is known to interfere with the efficient flow of air to a spinnaker sail, it has not been possible to equip scale model sailing craft with both jib and spinnaker sails without detracting from the efficiency of the spinnaker sail.

SUMMARY OF THE INVENTION

The present invention overcomes the foregoing and other drawbacks of prior sailing craft, and provides a system for launching and retracting selected sails of a sailing craft.

A feature of the present invention is that a single, relatively simple, reversible drive system can be used to selectively launch and retract a sail and stow the sail in a designated above or below-deck storage area.

Another feature is that the drive system can be used to selectively launch and retract two sails. In preferred practice, the drive system operates to alternately launch and retract a spinnaker sail and a jib sail.

A further feature of the present invention is that the drive system can be used to stow two retractable sails in separate above and below-deck storage areas. Where spinnaker and jib sails are connected to the drive system, the spinnaker is preferably stowed below-deck while the jib is unfurled, and the jib is preferably stowed on-deck while the spinnaker is unfurled.

The drive system preferably includes a reversible electric motor which is operated by a radio signal responsive servo switch. A remote control operated reversible electric motor of this type is described in the referenced Remote Control Boat Patent.

The drive system includes a rotatably mounted drum means having a peripheral surface. Elongated flexible means, typically a system of one or more ropes or cables, has a portion which is connected to a movable part of a retractable sail. The flexible means extends from the sail connection portion in a substantially continuous loop. The loop has a reach which drivingly engages the peripheral surface of the drum means. Guide means, typically a system of guides and/or pulleys, tensions the loop and supports the sail connection portion for movement between locations where the movable sail part is launched and retracted. Sail launching and retraction is effected by rotating the drum means selectively in opposite directions.

As will be apparent from the foregoing discussion, it is a general object of the present invention to provide a novel and improved system for retracting and launching selected sails of a sailing craft.

Other objects and a fuller understanding of the invention may be had be referring to the following description and claims taken in conjunction with the accompanying drawings.

DESCRIPTION OF THE PREFERRED EMBODIMENT

Figures 1, 2:
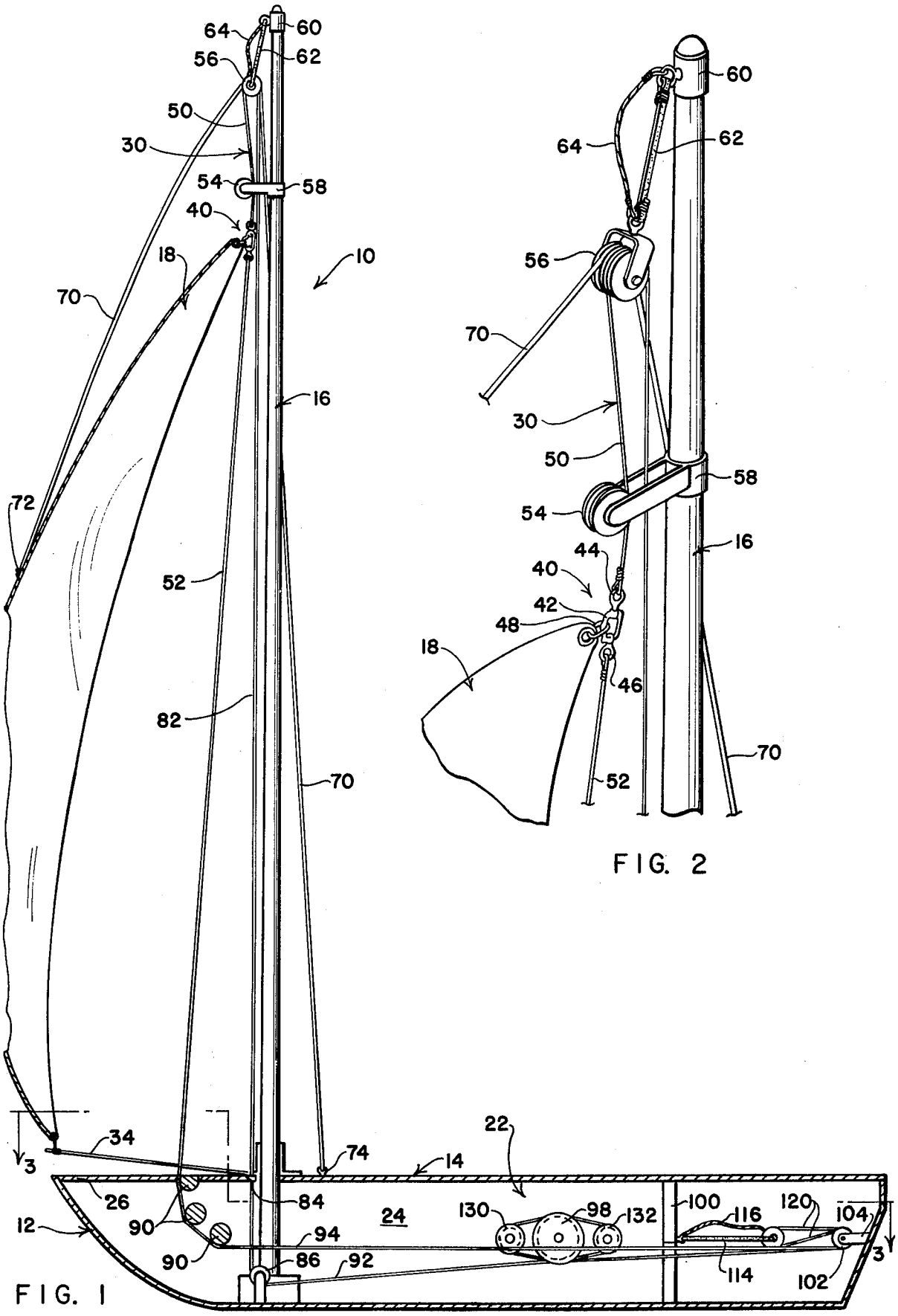
FIG. 1 is a side elevational view of a sailing craft having a retractable sail, some parts of the craft being broken away and shown in cross-section.
FIG. 2 is an enlarged perspective view of a portion of the sailing craft of FIG. 1.

Referring to FIG. 1, a sailing craft is indicated generally by the numeral 10. The craft 10 has a hull 12, a deck 14 and a mast 16. A spinnaker sail 18 is shown unfurled and supported by the mast 16. While the craft 10 is preferably sloop-rigged to include jib and main sails, only the spinnaker sail 18 is shown in FIG. 1. A remote control halyard drive system 22 is provided to launch and retract the spinnaker sail 18.

The hull 12 and the deck 14 cooperate to define a below-deck space 24. An opening 26 is formed through the deck 14 near the bow of the hull 12 and provides access to the space 24. The space 24 serves the dual functions of providing a storage area for the spinnaker sail 18 when it is furled, and of housing the halyard drive system 22.

Figure 3:
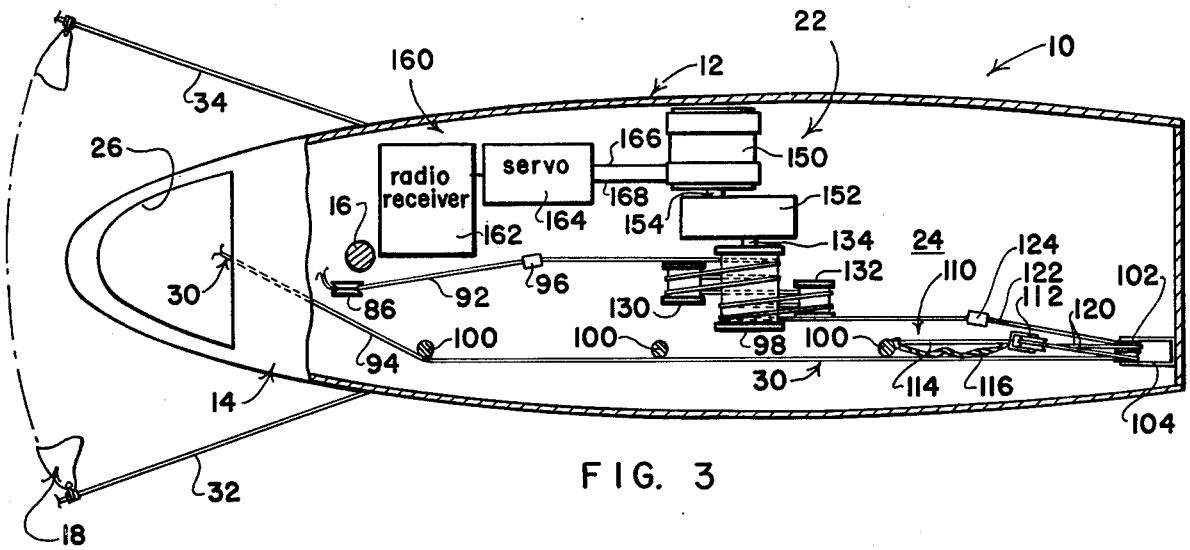
FIG. 3 is a sectional view as seen from planes indicated by broken line 3—3 in FIG. 1.

The spinnaker sail 18 is of conventional, triangular shaped construction. The upper corner of the spinnaker 18 is supported by a halyard cable 30. The lower corners of the spinnaker 18 are connected to whisker poles 32, 34. As is best seen in FIG. 3, the whisker poles 32, 34 are secured to opposite sides of the hull 12 and serve as "spreaders" for the bottom of the unfurled spinnaker sail 18. The whisker poles 32, 34 are formed from resilient material such as spring steel which permits their sail-connected ends to close toward the opening 26 when the spinnaker 18 is retracted and stored in the below-deck space 24.

A swivel connector assembly 40 couples the upper corner of the spinnaker 18 to the halyard cable 30. Referring to FIG. 2, the connector assembly includes an elongated yoke 42 and two eyes 44, 46 which are rotatable relative to the yoke 42. A link 48 extends through the yoke 42 and connects with the upper corner of the spinnaker sail 18. The halyard 30 has a reach 50 which connects with the eye 44 and extends upwardly along the mast 16, and a reach 52 which connects with the eye 46 and extends downwardly toward the deck opening 26.

Single and double pulleys 54, 56 are supported on the upper end region of the mast 16. A bracket assembly 58 is secured to the mast 16 and rotatably mounts the single pulley 54. A bracket assembly 60 is secured to the top of the mast 16. An elastically extensible bungee cord 62 interconnects the bracket assembly 60 and the double pulley 56. A halter cable 64 also interconnects the bracket assembly 60 and the double pulley 56, and limits the stretching of the bungee cord 62.

Referring again to FIG. 1, a long, elastically extensible spinnaker bungee cord 70 has one end 72 connected to a midpoint on the spinnaker sail 18. The cord 70 extends upwardly from its end connection 72, is reeved around the double pulley 56, and extends downwardly to a point of connection 74 with the deck 14. The spinnaker bungee cord 70 helps to hold the spinnaker sail 18 out of the water when it is being retracted for storage below deck. During retraction of the spinnaker sail 18, the cord 70 stretches toward and extends through the deck opening 26 with the spinnaker 18.

One end region of the halyard cable 30 extends upwardly from the swivel connector assembly 40 and is reeved around thedouble pulley 56. The cable 30 has a reach 82 which extends downwardly from the double pulley 56 along the mast 16, through a cable passage 84 formed in the deck 14, and is reeved around a pulley 86 at the base of the mast 16. The other end region of the halyard cable 30 includes the reach 52 which extends downwardly from the connector assembly 40 through the deck opening 26 and is reeved around three horizontally extending guide members or rollers 90. Reaches 92, 94 extend rearwardly through the below-deck space 24 from the pulley 86 and from the guide members 90 for connection with the halyard drive system 22.

Referring to FIG. 3, the halyard reach 92 extends from the pulley 86 through a fairlead 96 and toward a cable drum 98. The halyard reach 94 extends alongside three vertically extending guide stanchions 100 and is reeved around a double pulley 102. A bracket 104 supports the double pulley 102 on the transom of the hull 12.

A bungee tensioner 110 is provided in the below-deck space 24 to tension portions of the halyard cable 30. The tensioner 110 includes a single pulley 112, and elastically extensible bungee cord 114 which extends from the pulley 112 to one of the stanchions 100, and a halter cable 116 which limits the extension of the bungee cord 114. A loop 120 of the halyard cable 30 extends from the double pulley 102 around the tensioner pulley 112. The loop 120 connects with the reach 94 and with a reach 122. The reach 122 extends forwardly from the double pulley 102 through a fairlead 124 and toward the cable drum 98.

Figure 4:
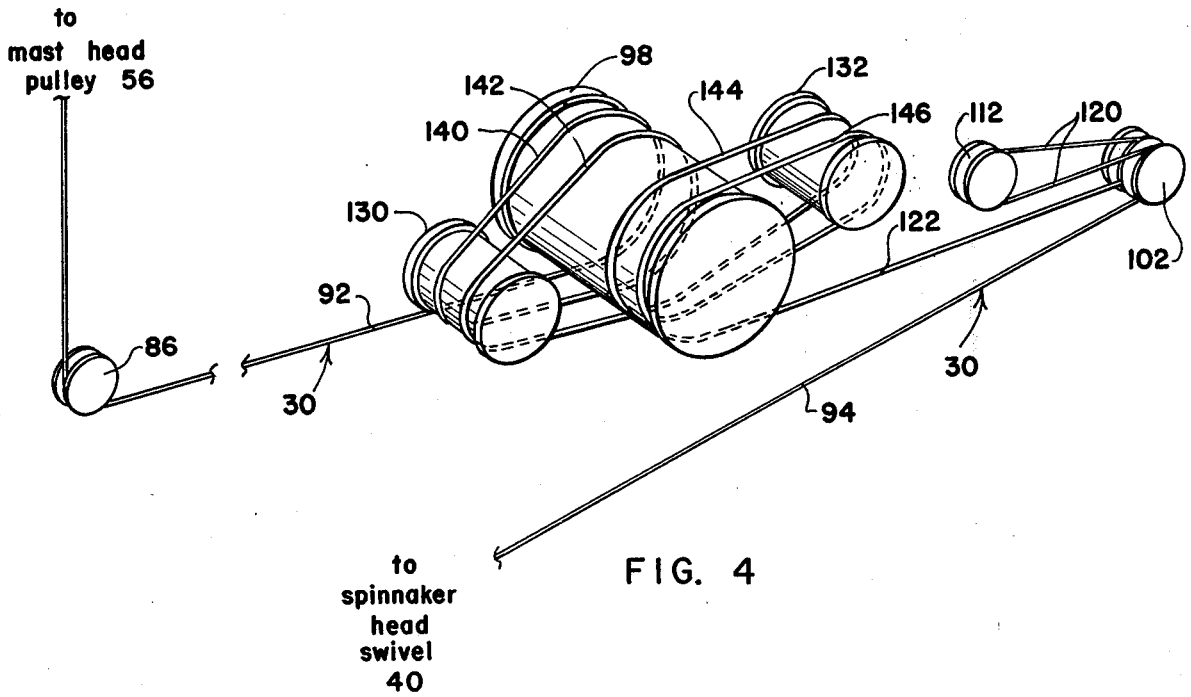
FIG. 4 is a schematic illustration showing the interconnection of several components of a drive system used in the craft of FIG. 1.

Referring to FIGS. 3 and 4, a pair of idler drums 130, 132 are provided on opposite sides of the cable drum 98. The cable drum 98 is supported for rotation by a shaft 134. The idler drums 130, 132 are of smaller diameter than the cable drum 98 and are supported for rotation about axes that parallel the axis of the shaft 134. Four loops 140, 142, 144, 146 are formed in the halyard cable 30 between the reaches 92, 122. The loops 140, 142 extend around the drums 98, 130, and the loops 144, 146 extend around the drums 98, 132.

The cable drum 98 preferably has a peripheral, cable engaging surface formed from hard rubber or other material having a relatively high coefficient of friction that will inhibit cable slippage. The idler drums 130, 132 can be formed from any suitable material and serve simply to prevent the halyard cable 30 from "threading" off of the drum 98 when the drum 98 is rotated to move the halyard cable 30.

Referring to FIG. 3, the halyard cable drive system 22 additionally includes a motor 150 and a transmission 152. The motor 150 is preferably a reversible 6 volt D.C. motor which has a drive shaft 154. The transmission 152 drivingly interconnects the motor drive shaft 154 and the cable drum shaft 134, and provides a gear reduction of about 25 to 1 or 30 to 1.

A remote control responsive system 160 is provided to selectively operate the motor 150 in forward and reverse drive directions. The system 160 is preferably of the type described in the referenced Remote Control Boat Patent and includes a radio receiver 162 and a servo switch 164. The receiver 162 responds to commands from a remotely located radio transmitter (not shown) and operates the servo switch 164. The servo switch 164 supplies electrical energy on command from the receiver 162 through conductors 166, 168 to operate the reversible motor 150 selectively in forward and reverse drive directions. A 6 volt D.C. battery (not shown) supplies electrical energy to the control system 160.

Retracting the spinnaker sail 18 is accomplished by energizing the motor 150 to reel the halyard cable reach 122 onto the cable drum 98. As the swivel connection assembly 40 is lowered to pull the upper corner of the spinnaker 18 toward the deck opening 18, the spinnaker bungee cord 70 holds mid portions of the spinnaker 18 out of the water. As the swivel connection assembly 40 passes around the guides 90 and is drawn along the guide stanchions 100 into the space 24, the bungee cord 70 stretches and follows the spinnaker 18 into the space 24. As the spinnaker 18 reaches its storage position in the below-deck space 24, the whisker poles 32, 34 deflect toward and close over the deck opening 26.

Launching the spinnaker sail 18 from the below-deck storage space 24 is effected by energizing the motor 150 to reel the halyard cable reach 92 onto the cable drum 98. As the swivel connection assembly 40 emerges through the deck opening 26, the upper corner of the spinnaker 18 is raised above deck. The inwardly deflected whisker poles 32, 34 and the extended bungee cord 70 return to their normal positions and quickly unfurl the spinnaker 18, preventing its becoming fouled in the process. When the connector assembly 40 reaches the position in FIG. 1, the spinnaker is fully unfurled.

Figure 5:
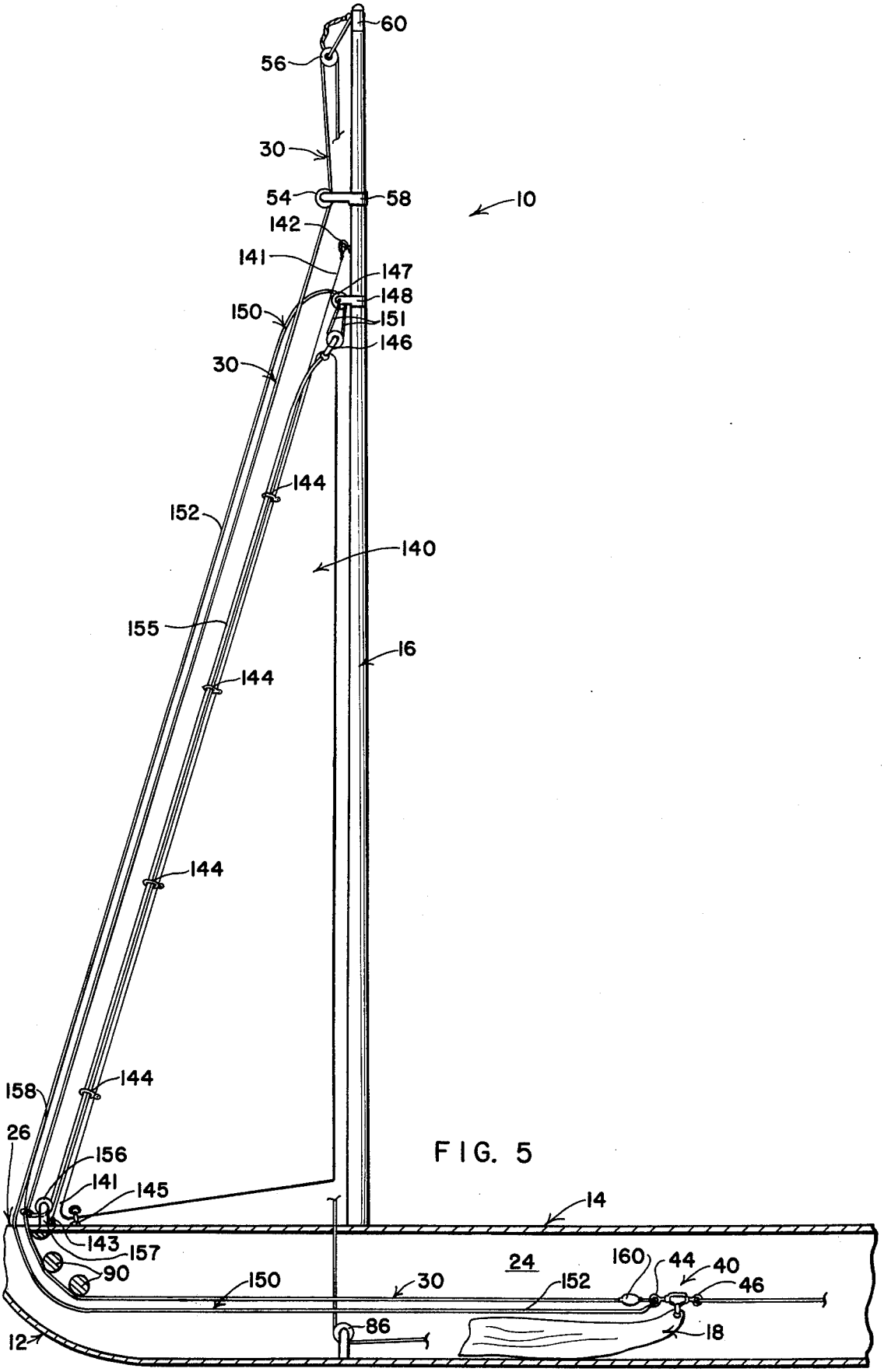
FIG. 5 is a side elevational view of the sailing craft of FIG. 1 as modified to include a second retractable sail, the second sail being in a luanched position and the first sail being retracted, portions of the craft being broken away and shown in cross section; and, FIG. 6 is a view similar to FIG. 5 with both sails intermediate their launched and retracted positions.

In preferred practice, the halyard cable drive system 22 is also used to launch and retract a jib sail. Referring to FIG. 5, a jib sail 140 is shown unfurled and supported by the mast 16. As will be explained, when the jib sail 140 is unfurled, the spinnaker sail 18 is retracted into the below-deck space 24; and when the spinnaker 18 is unfurled, the jib sail 140 is furled on the deck 14.

The luff of the jib sail 140 is supported by a wire stay 141. The wire stay 141 has its opposite ends connected to eyelets 142, 143. The eyelet 142 is secured to the mast 16. The eyelet 143 is secured to the deck 14. A plurality of slip rings 144 are secrued to the luff of the jib sail 140 and loosely engage the wire stay 141 to provide a sliding connection between the jibsail 140 and the wire stay 141.

A deck fastener 145 connects with a bottom corner of the jib sail 140. A single pulley 146 connects with a top corner of the jib sail 140. A single pulley 147 is supported on a mast bracket 148 at a location above the jib sail 140. A jibsail halyard 150 has one end secured to the mast bracket 148. The halyard 150 has a reach 151 which extends downwardly from the bracket 148, reeves around the jibsail pulley 146, extends upwardly and reeves around the pulley 147. The jibsail halyard 150 has a reach 152 which extends downwardly from the pulley 147 alongside the spinnaker halyard 30 and connects with the connector eye 44. This arrangement of the jibsail halyard 150 will cause the jib sail 140 to be launched during retraction of the spinnaker sail 18.

An elastically extensible bungee cord 155 is provided to assure that the jib sail 140 retracts as the spinnaker sail 18 is launched. The jibsail bungee cord 155 has its upper end connected to the upper corner of the jib sail 140. The cord 155 extends through the eyelets 144 along the luft of the jib sail 140 and is reeved around a single pulley 156. A bracket 157 rotatably supports the pulley 156 on the deck 14. From the pulley 156, the bungee cord 155 extends forwardly and connects with a ring 158. The ring 158 extends loosely around the spinnaker halyard 30.

Figure 6:
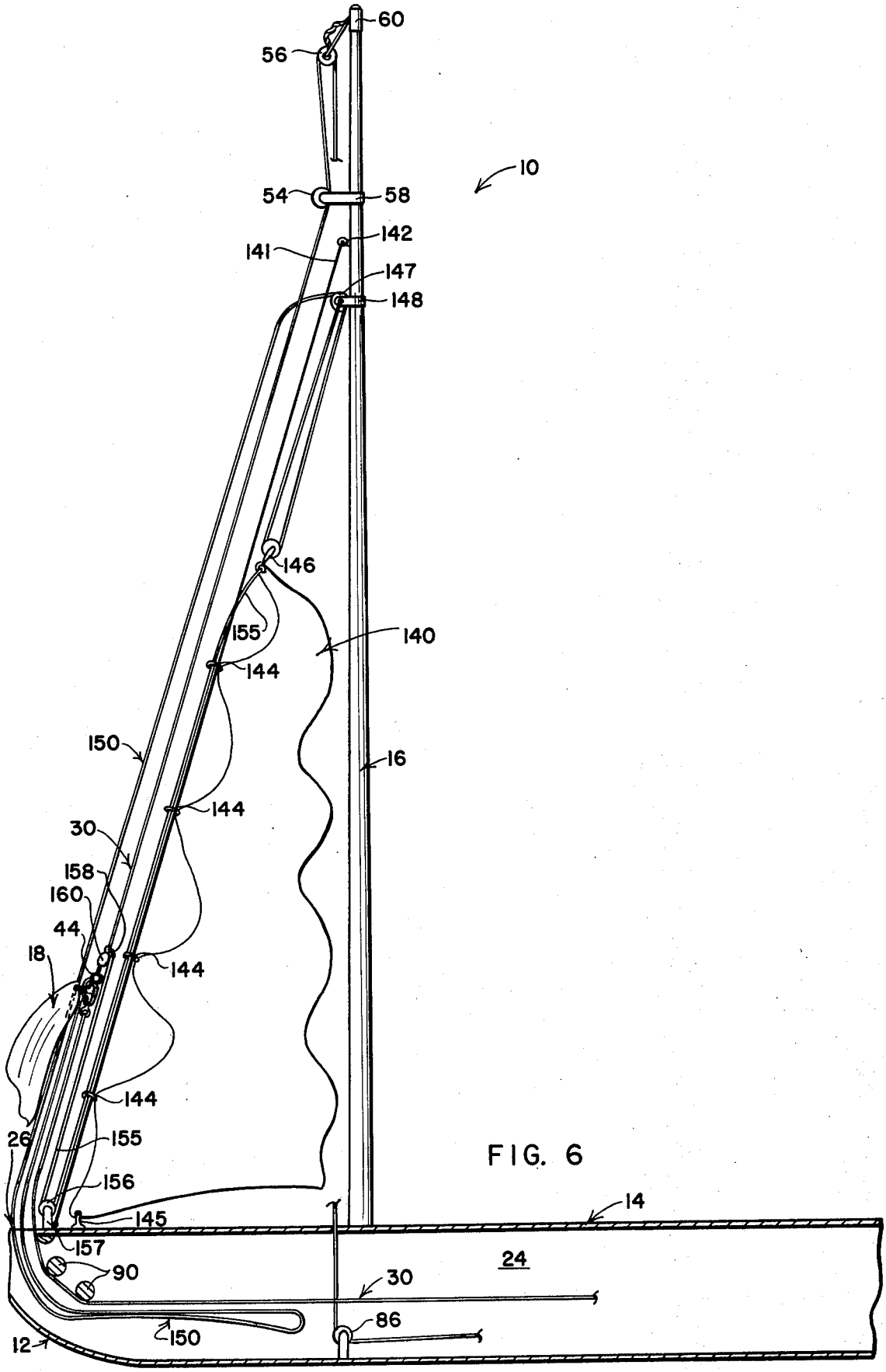

An ellipsoid-shaped bead 160 is carried on the spinnaker halyard 30 at a location near the connector eye 44. The bead 160 has an outer diameter that will not pass through the jibsail bungee ring 158. Referring to FIG. 6, during launching of the spinnaker 18, the bead 160 engages the ring 158 and tensions the jibsail bungee cord 155. As the cord 155 is tensioned, it causes the jib sail 140 to retract and assume a furled storage position atop the deck 14.

As will be apparent from the foregoing description, the present invention provides a novel and improved system for launching and retracting sails. While the described preferred embodiment utilizes the system to launch and retract spinnaker and jib sails on a scale model boat, it will be apparent to those skilled in the art that the system has application to full sized sailing craft, and that it can be used with many types of sails.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and the scope of the invention as hereinafter claimed. It is intended that the patent shall cover, by suitable expression in the appended claims, whatever features of patentable novelty exist in the invention disclosed.

What is claimed is:

1. A sail launching and retraction control apparatus for a sailing craft having a first sail with at least a part of the first sail being movable between positions where the first sail is launched and retracted, comprising:

a. rotatably mounted drum means having a peripheral surface;

b. elongated flexible means having a portion connected to the movable sail part and extending from such sail connection portion in a substantially continuous loop with a reach of the loop drivingly engaging the peripheral surface;

c. guide means for tensioning the loop and supporting the sail connection portion for movement between locations where the movable sail part is in the launched and retracted positions; and, d. reversible motor means for selectively rotating the drum means in opposite directions to move the loop and thereby launch and retract the first sail.

2. The apparatus of claim 1 including means for effecting remote control of said reversible motor means.

3. The apparatus of claim 1 wherein the first sail is a spinnaker sail.

4. The apparatus of claim 1 wherein the first sail is a jib sail.

5. The apparatus of claim 1 wherein the craft has a deck and the retracted position of the first sail is above deck.

6. The apparatus of claim 1 wherein the craft has a deck and the retracted position of the first sail is below deck.

7. The apparatus of claim 1 wherein:

a. the craft is provided with a second sail, at least a section of which is movable between positions where the second sail is furled and unfurled;

b. the elongated flexible means includes another portion which connects with the movable sail section; and c. the motor means is operative when rotating the drum means selectively in opposite directions to furl and unfurl the second sail.

8. The apparatus of claim 7 wherein the motor means is operative, when rotating the drum means in one direction, to launch the first sail and to furl the second sail; and when rotating the drum means in the opposite direction, to retract the first sail and unfurl the second sail.

9. The apparatus of claim 7 wherein:

a. the craft has a deck;

b. the retracted position of the first sail is below deck; and c. the furled position of the second sail is above deck.

10. The apparatus of claim 7 wherein the first sail is a spinnaker sail and the second sail is a jib sail.

11. The apparatus of claim 1 wherein:

a. the craft has a deck and a mast which extends upwardly from the deck;

b. the guide means includes a pulley carried on the mast;

c. the launched position of the first sail is located below the pulley alongside the mast;

d. the retracted position of the first sail is in a region below deck;

e. the drum means and the motor means are housed below deck;

f. an opening is formed through the deck; and g. the loop extends from the drum means through a portion of the below deck region which defines the retracted position, through the opening, and upwardly to the pulley.

12. The apparatus of claim 11 wherein the guide means additionally includes spaced members carried below deck to guide portions of the loop and the first sail into the region which defines the retracted position.

13. The apparatus of claim 1 wherein the guide means includes auxiliary drum means rotatably carried near the drum means for engaging the loop and preventing the loop reach from threading off the drum means during rotation of the drum means by the motor means.

14. The apparatus of claim 13 wherein the auxiliary drum means includes first and second auxiliary drums having diameters less than that of the drum means and being positioned on opposite sides of the drum means to engage portions of the loop near the loop reach and prevent the loop reach from threading off the drum means.

15. The apparatus of claim 1 wherein the guide means includes first and second tensioning means each of which engages and tensions a separate one of two loop portions which extend between the drum means and the sail connection.

16. An apparatus for selectively launching and retracting one of two retractable sails on a sailing craft, comprising:

a. rotatably mounted drum means having a peripheral surface;

b. elongated flexible means having portions connected to both sails and extending from such portions in a substantially continuous loop with a reach of the loop drivingly engaging the peripheral surface;

c. guide means for tensioning the loop and supporting the loop for movement between a first position where the sail connected portions launch one sail and retract the other sail, and a second position where the sail connected portions launch the other sail and retract the one sail; and d. reversible drive means for selectively rotating the drum means in opposite directions to move the loop between the first and second positions.

17. The apparatus of claim 16 including means for effecting remote control of said reversible drive means.

18. The apparatus of claim 16 wherein one of the sails is a jib sail.

19. The apparatus of claim 16 wherein one of the sails is a spinnaker sail.

20. The apparatus of claim 16 wherein the craft has a deck and the retracted position of one of the sails is above deck.

21. The apparatus of claim 16 wherein the craft has a deck and the retracted position of one of the sails is below deck.

22. The apparatus of claim 16 wherein :

a. the craft has a deck and a mast which extends upwardly from the deck;

b. the guide means includes a first pulley carried on the mast;

c. the launched position of one of the sails is located below the first pulley;

d. the retracted position of the one sail is in a region below deck;

e. the drum means and drive means are housed below deck;

f. an opening is formed through the deck; and;

g. the loop extends from the drum through a portion of the below deck region which defines the retracted position through the opening, and upwardly to the first pulley.

23. The apparatus of claim 22 wherein: ;p1 a. the guide means includes a second pulley carried on the mast;

b. the launched position of the other of the sails is below the second pulley;

c. the retracted position of the other sail is above deck; and d. the flexible means portion which connects with the other sail is reeved around the second pulley.

24. The apparatus of claim 16 wherein an extensible bungee cord connects with one of the sails and helps to assure retraction of such one sail without ensnarlment.

25. The apparatus of claim 16 wherein separate extensible bungee cords connect with each of the sails and help assure retraction of the sails without ensnarlment.

* * * * *